United States Patent [19]

Thompson

[11] 4,303,331

[45] Dec. 1, 1981

[54] MAGNET FOR USE IN A MAGNETIC BRUSH DEVELOPMENT SYSTEM

[75] Inventor: Robert L. Thompson, Webster, N.Y.

[73] Assignee: Xerox Corporation, Stamford, Conn.

[21] Appl. No.: 91,421

[22] Filed: Nov. 5, 1979

[51] Int. Cl.[3] ..... G03G 15/00

[52] U.S. Cl. ..... 355/3 DD; 118/657; 118/652; 355/15

[58] Field of Search ..... 355/3 DD, 15; 118/657, 118/658, 652; 430/122

[56] References Cited

U.S. PATENT DOCUMENTS 3,392,432 7/1968 Naumann ..... 355/3 DD
3,641,969 2/1972 Hakanson ..... 118/658 X
3,643,629 2/1972 Kangas et al. ..... 118/658
3,952,701 4/1976 Yamashita et al. ..... 118/658

*Primary Examiner*—Richard L. Moses
*Attorney, Agent, or Firm*—H. Fleischer; H. M. Brownrout

[57] ABSTRACT

A magnetic member in which the magnetic portion thereof is magnetized to saturation impressing a plurality of magnetic poles thereon. At least one non-magnetic portion is integral with the magnetic portion so that the volume of magnetic material within the magnetic member varies producing a magnetic field having a preselected intensity profile. The magnetic member may be utilized in a development system or cleaning system of an electrophotographic printing machine.

19 Claims, 6 Drawing Figures

MAGNET FOR USE IN A MAGNETIC BRUSH DEVELOPMENT SYSTEM

This invention relates generally to an electrophotographic printing machine, and more particularly concerns an apparatus for developing an electrostatic latent image recorded on a photoconductive member.

Generally, electrophotographic printing comprises charging a photoconductive member to a substantially uniform potential so as to sensitize the surface thereof. The charged portion of the photoconductive surface is exposed to a light image of the original document being reproduced. This records an electrostatic latent image on the photoconductive member. The electrostatic latent image, which corresponds to the informational areas contained within the original document, is developed by bringing a developer material into contact therewith. In this way, a toner powder image is formed on the photoconductive member which is subsequently transferred to a copy sheet. The copy sheet is then heated to permanently affix the powder image thereto.

A suitable developer mix comprises toner particles adhering triboelectrically to carrier granules. Generally, the toner particles are made from a thermoplastic resin with the carrier granules being made from a ferromagnetic material. This two component mixture is brought into contact with the photoconductive surface. The toner particles are attracted from the carrier granules to the electrostatic latent image. This forms a powder image on the photoconductive surface. Various methods have been devised for applying the developer material to the latent image. For example, the developer material may be cascaded over the latent image so that the toner particles are attracted from the carrier granules thereto. Other techniques include the use of magnetic field producing devices, generally known in the art as magnetic brush development systems, for forming brush-like tufts of developer material extending outwardly therefrom and contacting the photoconductive surface to develop the latent image with toner particles. Hereinbefore, it has been difficult to develop both the large solid areas and the lines within the electrostatic latent image. In magnetic brush development systems, it has been found that developer materials having higher conductivities optimize development of solid areas while developer materials having lower conductivities optimize development of lines. The conductivity of the developer material may be varied by controlling the intensity of the magnetic field in the development zone. Previously, the magnet has been magnetized to different degrees relative to saturation about its periphery. However, small variations in the magnetization field or properties of the material frequently resulted in large variations in the magnetic field intensity. Hence, it is preferable to magnetize the magnetic member to saturation.

Various approaches have been devised to improve magnets utilized in magnetic brush development systems. The following disclosures appear to be relevant:

U.S. Pat. No. 3,392,432; Patentee: Naumann; Issued: July 16, 1968.

U.S. Pat. No. 3,952,701; Patentee: Yamashita et al.; Issued: Apr. 27, 1976.

U.S. Pat. No. 3,988,816; Patentee: Tada; Issued: Nov. 2, 1976.

The pertinent portions of the foregoing disclosures may be briefly summarized as follows:

Naumann describes a magnetic tube having nonmagnetic spacers between adjacent permanent magnets.

Yamashita et al. and Tada disclose a developer roller having a cylindrical magnet with variable strength magnetic poles impressed thereon.

In accordance with the features of the present invention, there is provided a magnetic member including a magnetic portion having a plurality of magnetic poles impressed thereon by magnetizing the magnetic portion to saturation. At least one non-magnetic portion is integral with the magnetic portion so that the volume of magnetic material therein varies. In this way, the magnetic portion generates a magnetic field having a preselected intensity profile.

Other aspects of the present invention will become apparent as the following description proceeds and upon reference to the drawings, in which:

FIG. 4(*b*) is an elevational view depicting another embodiment of the magnet used in the FIG. 3 developer roller; and FIG. 4(*c*) is an elevational view illustrating still another embodiment of the magnet used in the FIG. 3 developer roller.

While the present invention will hereinafter be described in connection with various embodiments thereof, it will be understood that it is not intended to limit the invention to these embodiments. On the contrary it is intended to cover all alternatives, modifications and equivalents as may be included within the spirit and scope of the invention as defined by the appended claims.

Figure 1:
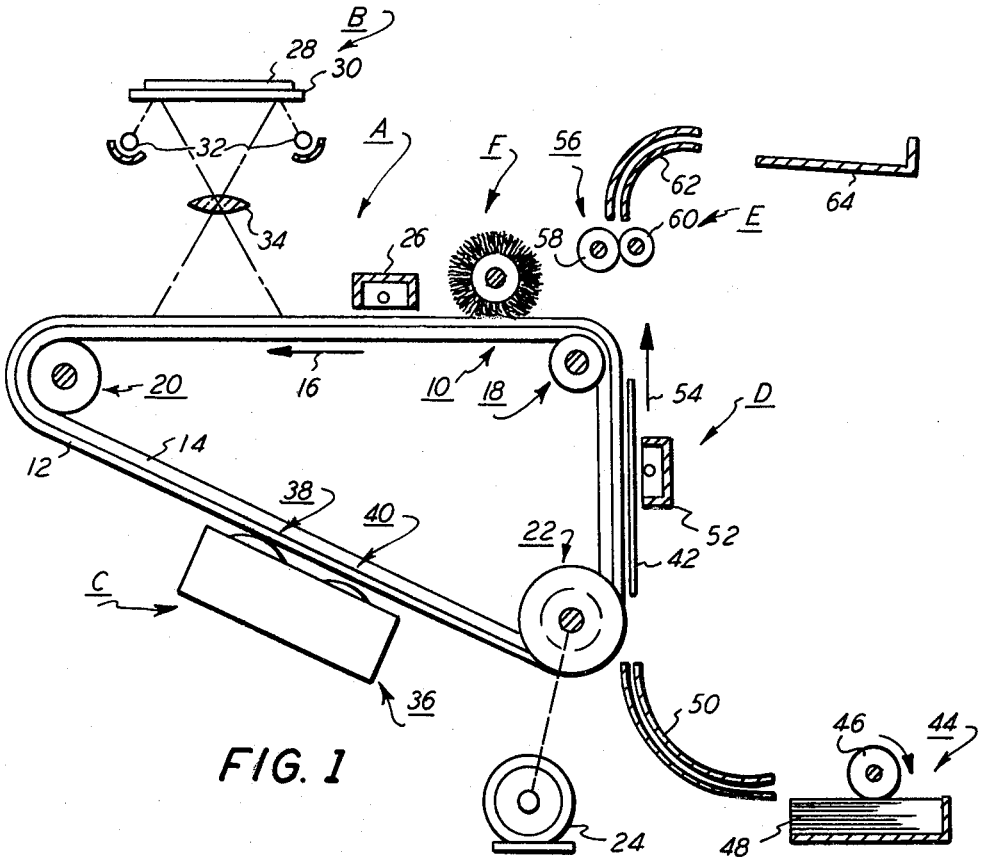
FIG. 1 is a schematic elevational view illustrating an electrophotographic printing machine incorporating the features of the present invention therein.

For a general understanding of the features of the present invention, reference is made to the drawings. In the drawings like reference numerals have been used throughout to designate identical elements. FIG. 1 schematically depicts the various components of an illustrative electrophotographic printing machine incorporating the development apparatus of the present invention therein. It will become apparent from the following discussion that this development apparatus is equally well suited for use in a wide variety of electrostatographic printing machines and is not necessarily limited in its application to the particular embodiment shown herein.

Inasmuch as the art of electrophotographic printing is well known, the various processing stations employed in the FIG. 1 printing machine will be shown hereinafter schematically and their operation described briefly with reference thereto.

As shown in FIG. 1, the electrophotographic printing machine employs a belt 10 having a photoconductive surface 12 deposited on a conductive substrate 14. Preferably, photoconductive surface 12 comprises a transport layer having small molecules of n-TBD dispersed in a polycarbonate and a generation layer of trigonal selenium. Conductive substrate 14 is made preferably from aluminized Mylar which is electrically grounded. Belt 10 moves in the direction of arrow 16 to advance successive portions of photoconductive surface 12 through the various processing stations disposed about the path of movement thereof. Belt 10 is entrained about stripping roller 18, tension roller 20, and drive roller 22. Drive roller 22 is mounted rotatably and in engagement with belt 10. Roller 22 is coupled to motor 24 by suitable means such as a belt drive. Motor 24 rotates roller 22 to advance belt 10 in the direction of arrow 16. Drive roller 22 includes a pair of opposed, spaced edge guides. The edge guides define a space therebetween which determines the desired path of movement for belt 10. Belt 10 is maintained in tension by a pair of springs (not shown) resiliently urging tension roller 20 against belt 10 with the desired spring force. Both stripping roller 18 and tension roller 20 rotate freely.

With continued reference to FIG. 1, initially a portion of belt 10 passes through charging station A. At charging station A, a corona generating device, indicated generally by the reference numeral 26, charges photoconductive surface 12 to a relatively high, substantially uniform potential.

Next, the charged portion of photoconductive surface 12 is advanced through exposure station B. At exposure station B, an original document 28 is positioned face-down upon transparent platen 30. Lamps 32 flash light rays onto original document 28. The light rays reflected from original document 28 are transmitted through lens 34 forming a light image thereof. Lens 34 focuses the light image onto the charged portion of photoconductive surface 12 to selectively dissipate the charge thereon. This records an electrostatic latent image on photoconductive surface 12 which corresponds to the informational areas contained within original document 28.

Thereafter, belt 10 advances the electrostatic latent image recorded on photoconductive surface 12 to development station C. At development station C, a magnetic brush development system, indicated generally by the reference numeral 36, transports a developer material with carrier granules and toner particles into contact with photoconductive surface 12. Preferably, magnetic brush development system 36 includes two magnetic brush developer rollers 38 and 40. These developer rollers each advance the developer material into contact with photoconductive surface 12. Each developer roller forms a chain-like array of developer material extending outwardly therefrom. The toner particles are attracted from the carrier granules to the electrostatic latent image forming a toner powder image on photoconductive surface 12 of belt 10. The detailed structure of magnetic brush development system 36 will be described hereinafter with reference to FIGS. 2, 3, 4(*a*), 4(*b*), and 4(*c*).

Belt 10 then advances the toner powder image to transfer station D. At transfer station D, a sheet of support material 42 is moved into contact with the toner powder image. The sheet of support material is advanced to transfer station D by a sheet feeding apparatus 44. Preferably, sheet feeding apparatus 44 includes a feed roll 46 contacting the uppermost sheet of stack 48. Feed roll 46 rotates so as to advance the uppermost sheet from stack 48 into chute 50. Chute 50 directs the advancing sheet of support material into contact with photoconductive surface 12 in a timed sequence so that the toner powder image developed thereon contacts the advancing sheet of support material at transfer station D.

Transfer station D includes a corona generating device 52 which sprays ions onto the backside of sheet 42. This attracts the toner powder image from photoconductive surface 12 to sheet 42. After transfer, the sheet continues to move in the direction of arrow 54 onto a conveyor (not shown) which advances the sheet to fusing station E.

Fusing station E includes a fuser assembly, indicated generally by the reference numeral 56, which permanently affixes the transferred toner powder image to sheet 42. Preferably, fuser assembly 56 includes a heated fuser roller 58 and a back-up roller 60. Sheet 42 passes between fuser roller 58 and back-up roller 60 with the toner powder image contacting fuser roller 58. In this manner, the toner powder image is heated so as to be permanently affixed to sheet 42. After fusing, chute 62 guides the advancing sheet 42 to catch tray 64 for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a pre-clean corona generating device (not shown) and a rotatably mounted fiberous brush 66 in contact with photoconductive surface 12. The pre-clean corona generating device neutralizes the charge attracting the particles to the photoconductive surface. The particles are then cleaned from photoconductive surface 12 by the rotation of brush 66 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine.

Figure 2:
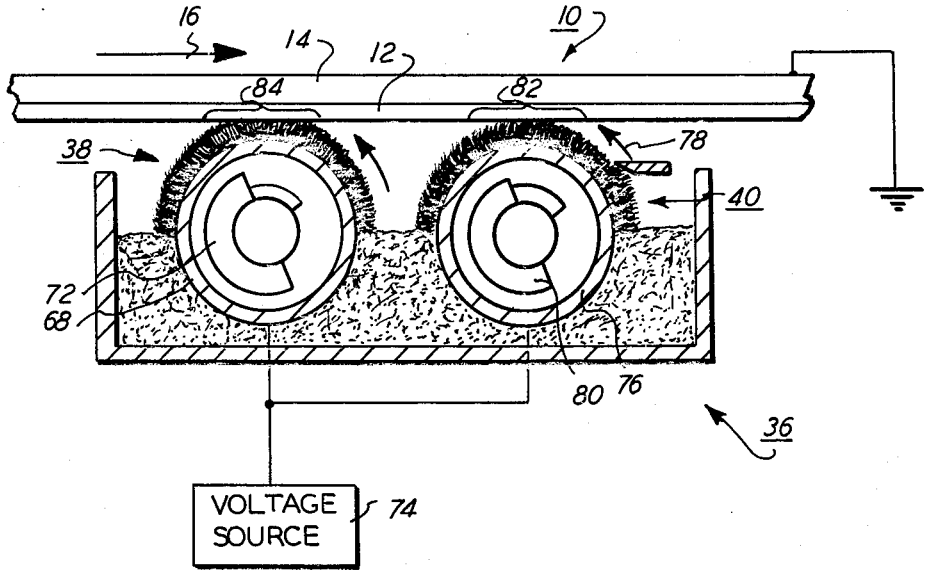
FIG. 2 is a schematic elevational view showing a development system used in the FIG. 1 printing machine.

Referring now to the specific subject matter of the present invention, FIG. 2 depicts development system 36 in greater detail. As depicted thereat, developer roller 38 includes a non-magnetic tubular member 68 journaled for rotation. By way of example, tubular member 68 may be made from aluminum having the exterior circumferential surface thereof roughened. Tubular member 68 rotates in the direction of arrow 70. Magnetic member 72 is positioned within tubular member 68 being spaced from the interior circumferential surface thereof. Magnetic member 72 is magnetized to saturation. However, the volume (thickness) of magnetic material varies about the periphery thereof so that the magnetic field intensity varies in accordance with a pre-selected profile. The detailed structure of magnetic member 72 will be described hereinafter with reference to FIGS. 4(*a*), 4(*b*), and 4(*c*). The magnetic field generated by a magnetic member 72 attracts the developer mixture to the exterior circumferential surface of tubular member 68. As tubular member 68 rotates in the direction of arrow 70, the developer member is moved into contact with photoconductive surface 12. The electrostatic latent image recorded on photoconductive surface 12 attracts the toner particles from the carrier granules forming a toner powder image thereon. Tubular member 68 is electrically biased by voltage source 74. Voltage source 74 generates a potential having a suitable polarity and magnitude to electrically bias tubular member 68 to the desired level. Preferably, voltage source 74 electrically biases tubular member 68 to a level intermediate that of the background or non-image area voltage levels and that of the electrostatic latent image. For example, tubular member 68 may be electrically biased to a potential ranging from about 50 volts to about 350 volts. In this manner, the electrostatic latent image attracts the toner particles from the carrier granules.

Developer roller 40 includes a non-magnetic tubular member 76 journaled for rotation. By way of example, tubular member 76 may be made from aluminum having the exterior circumferential surface thereof roughened. Tubular member 76 rotates in the direction of arrow 78. A magnetic member 80 is positioned within tubular member 76 being spaced from the interior circumferential surface thereof. Magnetic member 80 is magnetized to saturation to impress a plurality of poles thereon. However, the volume (thickness) of magnetic material in magnetic member 80 varies about the circumferential surface so that the magnetic field intensity varies similarly. In this way, the magnetic field intensity may be controlled to a pre-selected level about the periphery of magnetic member 80. The magnetic field generated by magnetic member 80 attracts the developer material to the exterior circumferential surface of tubular member 76. As tubular member 76 rotates in the direction of arrow 78, the developer material is moved into contact with photoconductive surface 12 to further develop the latent image with toner particles. Tubular member 76 is also electrically biased by voltage source 74. If tubular member 76 is biased to a voltage level different from the voltage biasing tubular member 68, a suitable resistor may be introduced into the circuit or a separate voltage source in lieu of voltage source 74 may be utilized to bias tubular member 76.

Magnetic member 80 is oriented relative to development zone 82 so as to produce a relatively weak magnetic field thereat. This optimizes development of lines. However, magnetic member 72 is oriented relative to development zone 84 so as to produce a relatively strong magnetic field thereat. This insures that solid areas within the electrostatic latent image are optimumly developed.

Preferably, the developer material includes conductive magnetic carrier granules having toner particles adhering thereto triboelectrically. By way of example, the carrier granules include a ferromagnetic core having a thin layer of magnetic overcoated with a non-continuous layer of resinous material. Suitable resins include poly(vinylidene fluoride) and poly (vinylidene fluoride-co-tetrafluoroethylene). The developer composition can be prepared by mixing the carrier granules with the toner particles. Suitable toner particles are prepared by finely grinding a resinous material and mixing it with a coloring material. By way of example, the resinous material may be a vinyl polymer such as polyvinyl chloride, polyvinylidene chloride, polyvinyl acetate, polyvinyl acetals, polyvinyl ether, and polyacrylic. Suitable coloring materials may be, amongst others, chromgen black and solvent black. The developer comprises about 95 to 99% by weight of carrier and from about 5 to about 1% weight of toner, respectively. These and other materials are disclosed in U.S. Pat. No. 4,076,857 issued to Kasper et al. in 1978, the relevant portions thereof being hereby incorporated into the present application.

Figure 3:
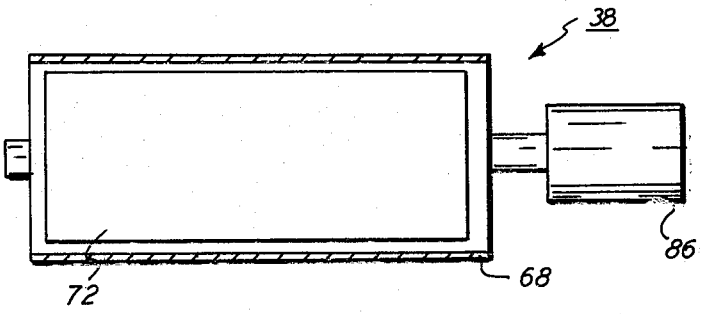
FIG. 3 is a schematic elevational view depicting a developer roller used in the FIG. 2 development system.

Inasmuch as developer rollers 38 and 40 are substantially identical to one another with the only distinction being in the orientation of the respective magnetic member relative to the development zone, FIG. 3, which describes the drive system for the developer roller, may be utilized for either of the foregoing. Thus, only the drive system for developer roller 38 will be described with reference to FIG. 3.

Turning now to FIG. 3, a constant speed motor 86 is coupled to tubular member 68. Tubular member 68 is mounted on suitable bearings so as to be rotatable. Magnetic member 72 is mounted substantially fixed interiorly of tubular member 68. Excitation of motor 86 rotates tubular member 68 in the direction of arrow 70 (FIG. 2). In this way, the developer mixture moves also in the direction of arrow 70.

Figure 4A:
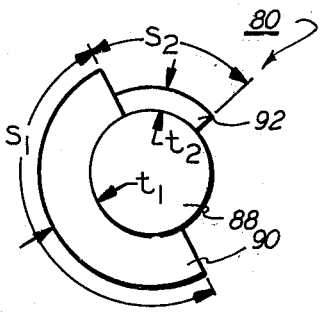
FIG. 4(*a*) is an elevational view showing one embodiment of a magnet used in the FIG. 3 developer roller.
Figure 4B:
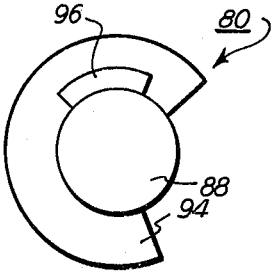
Figure 4C:
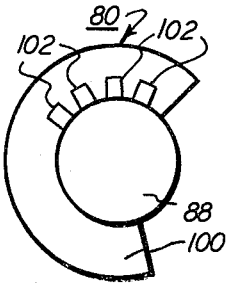

Turning now to FIGS. 4(*a*) through 4(*c*), inclusive, the detailed structure of various embodiments for either magnetic member 72 or magnetic member 80 are described therein. Inasmuch as magnetic members 72 and 80 may be identical to one another, with the only difference being in their relative orientation with respect to the development zone, only magnetic member 80 will be described hereinafter.

Referring now to FIG. 4(*a*), there is shown one embodiment of magnetic member 80. As depicted thereat, magnetic member 80 includes a steel shaft 88 having a magnetic member 90 secured adhesively thereto. Magnetic member 90 has a thickness $T_1$ and extends about an arc $S_1$. A second magnetic member 92 is adhesively secured to shaft 88 and also to magnetic member 90. Magnetic member 92 has a thickness $T_2$ and extends about an arc $S_2$. As shown in FIG. 4(*a*), $T_1$ is greater than $T_2$ with $S_1$ being greater than $S_2$. Effectively the total arc about which the magnetic member extends is equal to $S_1+S_2$ and a portion of magnetic material corresponding to the arc $S_2$ and a thickness $T_1-T_2$ is missing. Thus, magnetic member 80 may be viewed as having a thickness $T_1$ and extending about an arc $S_1+S_2$ with a non-magnetic portion or aperture therein extending about an arc $S_2$ having a thickness $T_1-T_2$. It is clear that the non-magnetic portion or aperture reduces the saturation of the magnetic field intensity in this region. In this way, the magnetic field intensity profile may be shaped. By appropriately orienting the magnetic member, conductivity of the developer material in the development zone is optimized. For example, if the non-magnetic portion were positioned adjacent the development zone, the conductivity of the developer material would be reduced and line development optimized. Contrariwise, if the thicker magnetic portion, i.e. the region of $T_1$ is positioned opposed from the development zone, the magnetic field intensity maximizes the conductivity of the developer material so as to optimize solid area development. Thus, by positioning magnetic member 80 relative to the development zone, one can optimize either solid area development or line development in the electrostatic latent image.

Referring now to FIG. 4(*b*), there is shown another embodiment of magnetic member 80. As shown thereat, magnetic member 80 includes a steel shaft 88 having a magnetic member 94 adhesively secured thereto. A portion of magnetic member 94 is removed therefrom and non-magnetic material 96 inserted therein in lieu thereof. Non-magnetic insert 96 is adhesively secured to magnetic member 94. Thus, it is seen that the amount (thickness) of magnetic material in the region of non-magnetic portion 96 is less than over the remaining region of magnetic member 94. In this way, the magnetic field intensity is shaped to the desired profile. For example, in the region of the non-magnetic portion 96, the amount of magnetic material is reduced and the potential magnetic field intensity is reduced. Hence, when non-magnetic portion 96 is positioned opposed from the development zone, the magnetic field intensity in the development zone is reduced resulting in a reduction in conductivity of the development material so as to optimize line development. However, when the non-magnetic member 96 is remotely located from the development zone, the magnetic field intensity is maximized resulting in higher developer material conductivity in the development zone so as to optimize solid area development. By way of example, non-magnetic insert 96 may be made of an iron-nickel alloy containing from about 20% to about 30% nickel.

Referring now to FIG. 4(*c*), there is shown still another embodiment of magnetic member 80. As shown in FIG. 4(*c*), magnetic member 80 includes a steel shaft 88 having a magnetic member 100 secured adhesively thereto. Magnetic member 100 has a plurality of slots 102 therein. In the region where slots 102 are located, there is less magnetic material than in the other regions of magnetic member 100. Hence, the intensity of the magnetic field in the region of slots 102 is reduced. Thus, by positioning slots 102 opposed from the development zone, the intensity of the magnetic field thereat is reduced. This results in reduced developer material conductivity so as to optimize line development. Alternatively, by positioning slots 102 remotely from the development zone, the magnetic field intensity is maximized resulting in a higher developer material conductivity so as to optimize solid area development.

In all of the foregoing embodiments hereinbefore discussed, the magnetic member is magnetized to saturation. Only through the reduction of magnetic material is the intensity of the magnetic field controlled. It is clear that the reduction in magnetic material results in a reduced magnetic field intensity in that region even though the magnetic material is magnetized to saturation. This shapes the intensity of the magnetic field so as to enable the magnetic member to produce both high and low intensity magnetic fields. The high intensity magnetic field is utilized to optimize solid area development while the low intensity magnetic field is utilized to optimize line development.

One skilled in the art will appreciate that while the magnet of the present invention has been described as being used in a magnetic brush development system, it may also be utilized in a magnetic brush cleaning system. In a magnetic brush cleaning system, a magnet is positioned interiorly of and spaced from a non-magnetic tubular member. Carrier granules are attracted to the non-magnetic tubular member. As the carrier granules are moved into contact with the photoconductive surface, they attract the residual toner particles from the photoconductive surface. In this manner, particles are cleaned from the photoconductive surface. Any of the various embodiments of the magnets depicted in FIGS. 4(*a*) through 4(*c*), inclusive, may be employed in the magnetic brush cleaning system.

In recapitulation, it is evident that the magnet of the present invention has magnetic poles impressed thereon by being magnetizing to saturation. Inasmuch as selected portions of the magnetic member are non-magnetic, the resultant magnetic field intensity in those regions is reduced. By orienting the magnetic member relative to the development zone, the magnetic field intensity may be maximized or minimized thereat. Minimization of the magnetic field intensity in the development zone optimizes line development while maximization of the magnetic field intensity in the development zone optimizes solid area development. Various embodiments may be utilized to achieve the foregoing. For example, non-magnetic portions may be inserted in the magnetic member to reduce the amount of magnetic material or apertures may be formed therein so as to achieve the foregoing. In addition, any of these magnets may be employed in a magnetic brush cleaning system as well as a magnetic brush development system.

It is, therefore, apparent that there has been provided, in accordance with the present invention a magnetic member having a pre-selected magnetic field intensity profile. This magnet fully satisfies the aims and advantages hereinbefore set forth. While this invention has been described in conjunction with specific embodiments thereof, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. A magnetic member for attracting magnetic particles to a transport of a reproducing machine, including:

an arcuate magnetic portion having a plurality of magnetic poles impressed thereon by magnetizing said magnetic portion to saturation; and at least one non-magnetic portion disposed interiorly of said magnetic portion so that the volume of magnetic material in the magnetic member varies producing a magnetic field having a pre-selected intensity profile.

2. A magnetic member as recited in claim 1, wherein said non-magnetic portion is an aperture in said magnetic portion.

3. A magnetic member as recited in claim 1, wherein said non-magnetic portion is made from a non-magnetic material.

4. A magnetic member as recited in claim 3, wherein said non-magnetic portion is adhesively secured to said magnetic portion.

5. A magnetic member as recited in claim 1, wherein said magnetic portion is an elongated, arcuate member having the magnetic poles impressed about the circumferential surface thereof.

6. An apparatus for use in a developing station or a cleaning station of a reproducing machine, including:

means for transporting magnetic particles closely adjacent to a recording member;

a magnetic member, operatively associated with said transporting means, for attracting the magnetic particles to said transporting means, said magnetic member having a plurality of magnetic poles impressed thereon by being magnetized to saturation; and at least one non-magnetic member disposed interiorly of said magnetic member so that the volume of magnetic material in said magnetic member varies producing a magnetic field having a pre-selected intensity profile.

7. An apparatus as recited in claim 6, wherein said non-magnetic member is an aperture in said magnetic member.

8. An apparatus as recited in claim 6, wherein said non-magnetic member is made from a non-magnetic material.

9. An apparatus as recited in claim 8, wherein said non-magnetic material is adhesively secured to said magnetic member.

10. An apparatus as recited in claim 9, wherein said magnetic member is an elongated, arcuate member having the magnetic poles impressed about the circumferential surface thereof.

11. An apparatus as recited in claim 10, wherein said transporting means includes:

an elongated, non-magnetic tubular member having said arcuate member disposed interiorly thereof and spaced from the interior circumferential surface of said tubular member; and means for rotating said tubular member.

12. An apparatus as recited in claim 10, wherein the developing station includes toner particles adhering triboelectrically to the magnetic particles.

13. An electrophotographic printing machine of the type having a photoconductive member arranged to have an electrostatic latent image recorded thereon, a developing station for transporting a developer material into contact with the latent image, and a cleaning station for removing particles from the surface of the photoconductive member, wherein the improved developing station or cleaning station includes:

means for transporting magnetic particles closely adjacent to the photoconductive member;

a magnetic member, operatively associated with said transporting means, for attracting the magnetic particles to said transporting means, said magnetic member having a plurality of magnetic poles impressed thereon by being magnetized to saturation; and at least one non-magnetic member disposed interiorly of said magnetic member so that the volume of magnetic material in said magnetic member varies producing a magnetic field having a pre-selected intensity profile.

14. A printing machine as recited in claim 13, wherein said non-magnetic member is an aperture in said magnetic member.

15. A printing machine as recited in claim 13, wherein said non-magnetic member is made from a non-magnetic material.

16. A printing machine as recited in claim 15, wherein said non-magnetic material is adhesively secured to said magnetic member.

17. A printing machine as recited in claim 13, wherein said magnetic member is an elongated, arcuate member having the magnetic poles impressed about the circumferential surface thereof.

18. A printing machine as recited in claim 17, wherein said transporting means includes:

an elongated, non-magnetic tubular member having said arcuate member disposed interiorly thereof and spaced from the interior circumferential surface of said tubular member; and means for rotating said tubular member.

19. A printing machine as recited in claim 17, wherein the developing station includes toner particles adhering triboelectrically to the magnetic particles.

* * * * *